US007871360B1

(12) United States Patent
Hoole

(10) Patent No.: US 7,871,360 B1
(45) Date of Patent: Jan. 18, 2011

(54) ADJUSTABLE WEIGHT-LOADED DIP-CHIN MACHINE

(76) Inventor: Richard J. Hoole, 102 Cunningham Dr., New Smyrna Beach, FL (US) 32168

( * ) Notice: Subject to any disclaimer, the term of this patent is extended or adjusted under 35 U.S.C. 154(b) by 476 days.

(21) Appl. No.: 11/811,920

(22) Filed: Jun. 11, 2007

(51) Int. Cl.
*A63B 21/00* (2006.01)

(52) U.S. Cl. ..... 482/142; 130/121

(58) Field of Classification Search ..... 482/142, 482/130, 121, 35–37, 38, 123, 100, 112–113, 482/137
See application file for complete search history.

(56) References Cited

U.S. PATENT DOCUMENTS

| | | | | |
|---|---|---|---|---|
| 3,207,511 | A | 9/1965 | Hoffman | |
| 3,707,285 | A | 12/1972 | Martin | |
| 4,111,414 | A * | 9/1978 | Roberts | 482/39 |
| 4,188,029 | A | 2/1980 | Brower et al. | |
| 4,620,701 | A * | 11/1986 | Mojden | 482/41 |
| 4,645,197 | A * | 2/1987 | McFee | 482/31 |
| 5,322,489 | A * | 6/1994 | Webb et al. | 482/38 |
| 5,372,556 | A | 12/1994 | Ropp | |
| 5,496,242 | A * | 3/1996 | Wang | 482/97 |
| 7,125,371 | B2 * | 10/2006 | Henderson | 482/142 |
| 7,166,066 | B2 * | 1/2007 | Webber | 482/100 |
| 2002/0132706 | A1 | 9/2002 | Sleamaker | |
| 2004/0018921 | A1 * | 1/2004 | Smith | 482/105 |
| 2005/0096198 | A1 | 5/2005 | Webber et al. | |
| 2005/0233875 | A1 * | 10/2005 | Clarke et al. | 482/123 |
| 2007/0197353 | A1 * | 8/2007 | Hundley | 482/93 |

* cited by examiner

*Primary Examiner*—Jerome Donnelly
(74) *Attorney, Agent, or Firm*—Paul S. Rooy PA

(57) ABSTRACT

An adjustable weight-loaded dip-chin machine. Dip bars and chin bars with means for vertical adjustment are mounted on columns, which in turn are mounted on a base. An arm is pivotally attached to the base, and weights can be added to an arm spindle attached to the arm. A belt is attached to the arm, and weights added to the arm spindle resist upward motion of an exerciser performing dips or chins. Elastic bands may be added connecting the arm to the base, and/or the belt to the base, which serve to render the exercise more strenuous. Dip bars incorporate a plurality of dip bar legs, each a differing distance from the other dip bar. Chin bars incorporate a downwardly-sloping dogleg. An alternate embodiment adjustable dip-chin machine incorporates a weight stack which can be attached to the belt. Stack weights selected from the weight stack render exercise more strenuous.

12 Claims, 8 Drawing Sheets

ADJUSTABLE WEIGHT-LOADED DIP-CHIN MACHINE

FIELD OF THE INVENTION

This invention relates to exercise machines, and in particular to an adjustable weight-loaded dip-chin machine.

BACKGROUND OF THE INVENTION

The dip-chin machine is one of the most important exercise machine available. This machine uses the resistance of one's own body to work the biceps, forearms, lateral muscles, triceps, chest, and shoulder muscles. Bars are provided for both dips and chins (also known as "chin-ups").

Dips are performed by pushing oneself above the level of a pair of parallel dip bars located approximately shoulder-width apart. The exerciser grasps a dip bar with each hand, then lowers his or her body until elbows are bent and shoulders mildly stretched. The arms are used to push the exerciser upwards to the starting position. Leaning the body forward with elbows kept in works the chest muscles more. Keeping the body straight vertically with elbows close to the body works the triceps more. More strenuous dips can be accomplished by not permitting the exerciser's feet to touch the floor at all during the course of the exercise.

Chins are performed by pulling oneself upwards above a pair of roughly co-linear chin bars, grasping one bar with each hand. The chin bars are located above the shoulder height of the exerciser. The exerciser begins by grasping a chin bar with each hand, with palms facing the exerciser. The exerciser then pulls himself or herself upwards until either chin or chest touches the chin bars. The exerciser then slowly lowers himself or herself back to the standing position from which the chin exercise was initiated. Chin exercises strengthen the biceps, forearms, and lateral muscles.

One problem associated with existing dip-chin machines is the lack of adjustability, either vertically or horizontally, of the dip bars and chin bars. This renders exercise difficult for non-standard sized exercisers. In addition, it would be desirable to vary the positions of the dip bars and chin bars in order to adjust the strenuousness of the dips and chins being performed, and to allow the exerciser to use the machine from an initial position standing either on the ground or on foot supports. This flexibility of use is not attainable unless the dip bars and chin bars are rendered adjustable on the dip-chin machine.

Another problem associated with currently available dip-chin machines is the inability to add resistance acting against the exerciser's upward motion during dips and chins, thereby rendering the exercise more strenuous. Currently available dip-chin machines are either not weightable, or provide means to use weights to aid the exerciser during the exercise, thus rendering the exercise less strenuous. Thus, in order to make the dips and chins more strenuous it would be desirable to provide means of adding weight against the exercise being performed, not in aid of the exercise. In addition, it would be desirable to provide means for using elastic to work against the exercise, thus increasing the exercise value.

One currently available option is for the exerciser to wear a weight belt, from which weights dangle. While these weights have the effect of increasing the weight of the exerciser, and hence the strenuousness of the exercise, the procedure can be dangerous if the weights swing into the exerciser's limb(s), or if the exerciser were to slip off of the elevated foot support(s) and the heavy weights land on the exerciser's feet or other body part. Thus, it would be desirable to provide a safe way to add weight against the dip or chin being performed.

SUMMARY OF THE INVENTION

Accordingly, it is an object of the present invention to provide an adjustable weight-loaded dip-chin machine which provides a varying amount of weight which the exerciser can add acting against the dip or chin being performed. Design features allowing this object to be accomplished include an arm pivotally attached to a frame, an arm spindle on the arm, and weights sized to fit onto the arm spindle. Advantages associated with the accomplishment of this object include the ability to adjust the intensity of dips and chins being performed, and the consequent enhancement of the exercise experience to the exerciser.

It is another object of the present invention to provide an adjustable weight-loaded dip-chin machine which provides a varying amount of resistance which the exerciser can add acting against the dip or chin being performed. Design features allowing this object to be accomplished include an arm pivotally attached to a frame, at least one pin attached to the frame, and an elastic band connecting a pin with the arm spindle, and/or an elastic band connecting a pin with a belt worn by the exerciser, and/or weights depending from the belt worn by the exerciser. Advantages associated with the accomplishment of this object include the ability to adjust the intensity of dips and chins being performed, and the consequent enhancement of the exercise experience to the exerciser.

It is still another object of this invention to provide an adjustable weight-loaded dip-chin machine to which weights and force which resist the dips and chins being performed may be added safely. Design features enabling the accomplishment of this object include an arm pivotally attached to a frame, an arm spindle attached to the arm, weights which may be removably installed on the arm spindle, and a belt worn by the exerciser attached to the arm by means of a belt line. Advantages associated with the realization of this object include elimination of the necessity for an exerciser to climb up onto elevated foot supports bearing heavy weights dangling from a weight belt, and elimination of the possibility of injury to the exerciser from these weights.

It is yet another object of this invention to provide an adjustable weight-loaded dip-chin machine which is inexpensive to manufacture. Design features allowing this object to be achieved include the use of components made of readily available materials, and the use of existing weights which may be removably added to an arm spindle. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Eight sheets of drawings are provided. Sheet one contains FIG. 1. Sheet two contains FIG. 2. Sheet three contains FIG. 3. Sheet four contains FIGS. 4 and 5. Sheet four contains FIGS. 4 and 5. Sheet five contains FIGS. 6 and 7. Sheet six contains FIGS. 8 and 9. Sheet seven contains FIGS. 10 and 11. Sheet eight contains FIG. 12.

DETAILED DESCRIPTION OF THE PREFERRED EMBODIMENT

Figure 1:
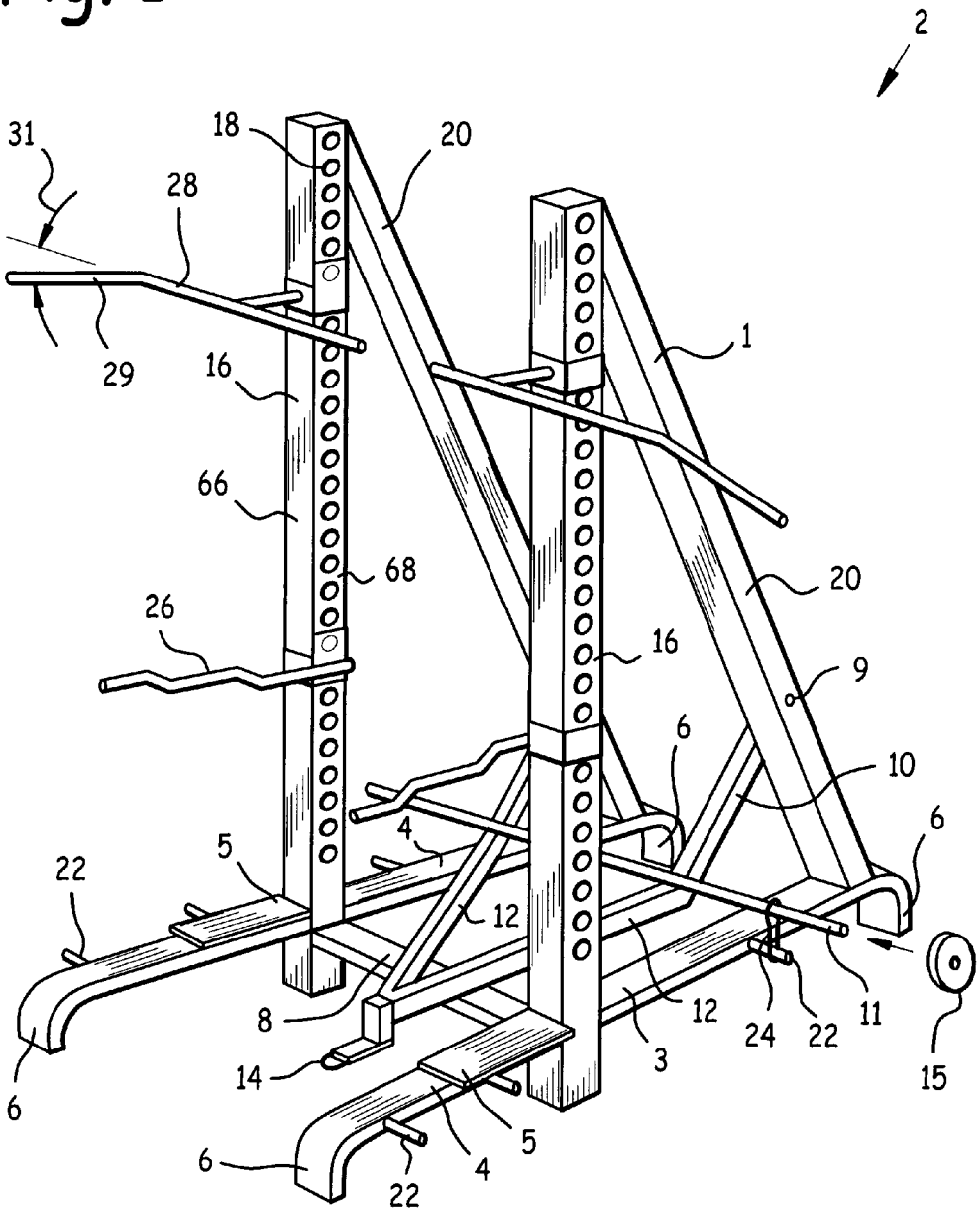
FIG. 1 is a right quarter side isometric view of an adjustable weight-loaded dip-chin machine.

Referring now to FIG. 1 we observe a right quarter side isometric view of adjustable dip-chin machine 2. Frame 1 is supported by base 3, and arm 10 is pivotally attached to frame 1 at arm pivot point 9. Arm 10 incorporates arm spindle 11, to which weights 15 may be removably attached. It is contemplated to fall within the scope of this invention that arm 10 may be pivotally attached to base 3, or pivotally attached to frame 1. Even if arm 10 is pivotally attached to frame 1, frame 1 is attached to base 3, so in this case it can fairly be said that arm 10 is pivotally mounted to base 3 by means of frame 1.

Frame 1 includes a pair of columns 16. Each column 16 has a dip bar 26 and/or a chin bar 28 adjustably attached to it. Thus, the instant invention teaches that each dip bar 26 and chin bar 28 may be adjusted along the height of a respective column 16, thereby rendering the instant adjustable dip-chin machine 2 the correct size for different exercisers, and also permitting the strenuousness of the exercises being performed to be varied.

Base 3 includes a pair of foot supports 5, which are elevated relative to a surface upon which adjustable dip-chin machine 2 rests. Thus, an exerciser using adjustable dip-chin machine 2 may stand on foot supports 5, or the surface upon which adjustable dip-chin machine 2 rests, while performing dips and/or chins.

In the preferred embodiment frame 1 comprised a pair of substantially parallel vertical columns 16, each supported by a column brace 20 extending from a respective column 16 to a rear portion of base 3. A rear extreme of arm 10 was pivotally attached to column braces 20. A forward portion of arm 10 rested on arm support 8, which extended horizontally between columns 16. Arm 10 comprised a pair of arm braces 12, one end of each arm brace 12 was rotatably attached to a respective column brace 20 at an arm pivot point 9, opposite ends of the arm braces were mutually attached, and arm ring 14 was attached to the end of the arm braces 12 opposite column braces 20. Each column 16 comprised a pair of opposed column faces 66 and column sides 68. A plurality of column apertures 18 were disposed in one column side 68, whereby the height of dip bar 26 and chin bar 28 could be adjusted.

In the preferred embodiment, base 3 included a pair of substantially parallel legs 4 extending from the rear to the front of adjustable dip-chin machine 2. Each leg 4 was supported at each end by a foot 6, and a foot support 5 was disposed atop each leg 4 forward of a column 16. At least one peg 22 was attached to base 3, in the preferred embodiment to leg 4 and/or foot support 5, to which elastic band(s) 24 could be attached to a belt 30 worn by the exerciser, and/or to arm spindle 11. Depending on the number and elasticity of elastic bands 24 connecting belt 30 and/or arm spindle 11 to pegs 22, the strenuousness of the exercise could be varied.

Figure 2:
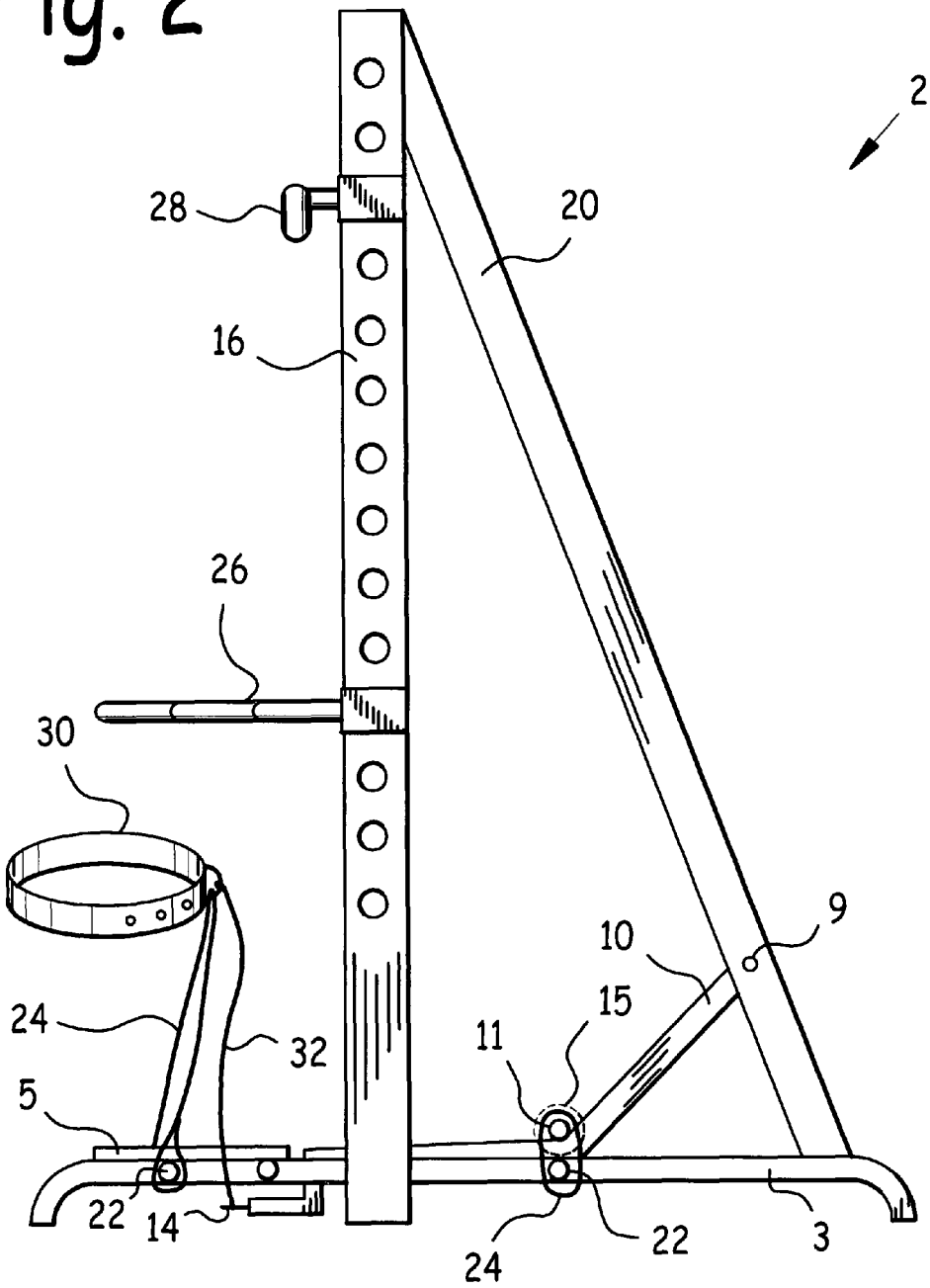
FIG. 2 is a right side view of an adjustable weight-loaded dip-chin machine with its arm in the resting position.
Figure 3:
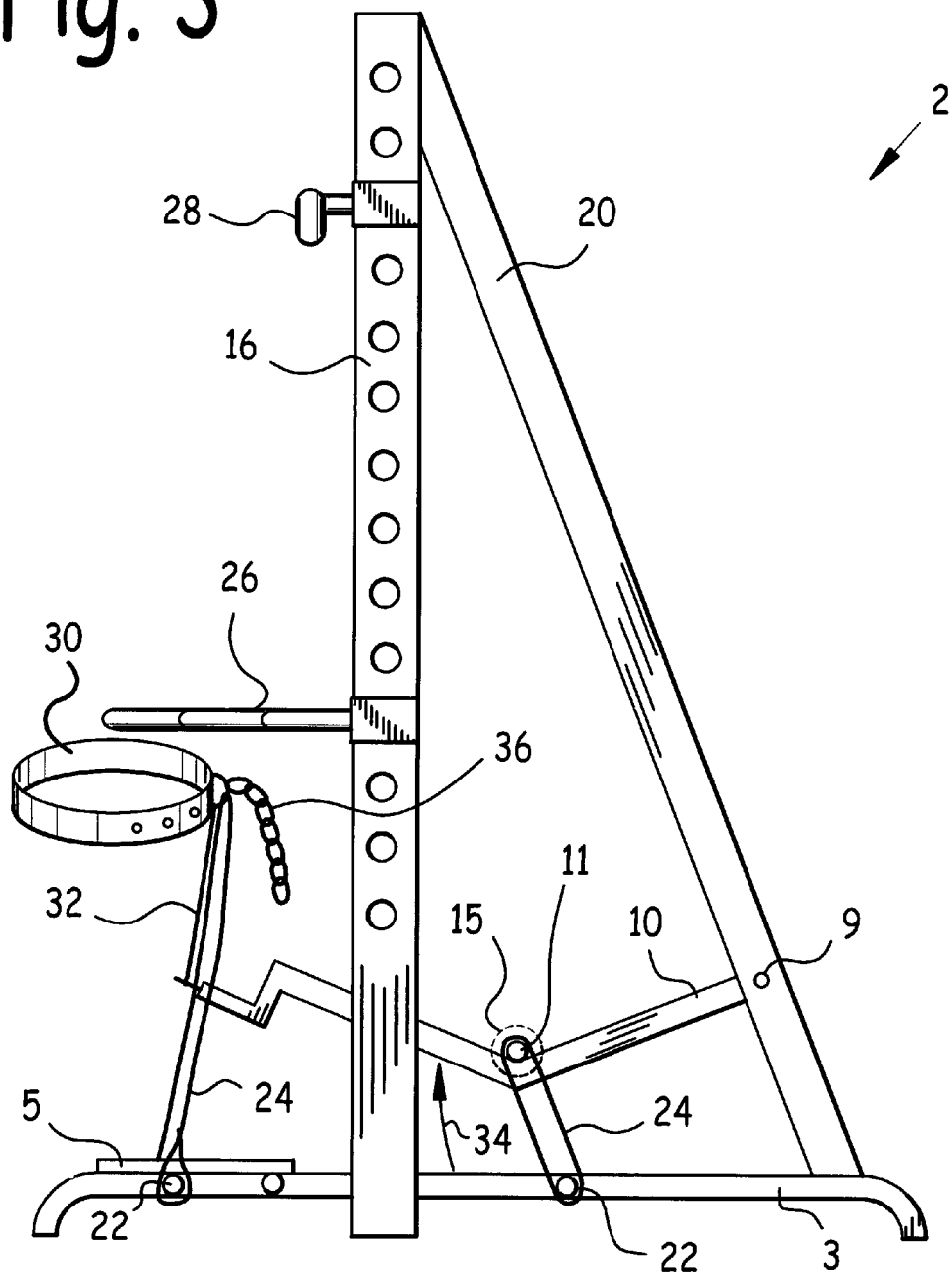
FIG. 3 is a right side view of an adjustable weight-loaded dip-chin machine with its arm in the elevated position.

FIG. 2 is a right side view of adjustable dip-chin machine 2 with its arm 10 in the resting position on arm support 8. FIG. 3 is a right side view of adjustable dip-chin machine 2 with its arm 10 in the elevated position. As may be observed in these figures, belt 30 (fastened around the waist of an exerciser, not shown) is attached to arm 10 by belt line 32, at arm ring 14. As an exerciser moves upwards while performing a dip or chin, so also does belt 30, and arm 10 as indicated by arrow 34 in FIG. 3, because belt 30 is attached to arm 10 by means of belt line 32.

Arm 10 may be weighted down by a variable number of weights 15 on arm spindle 11, as desired by the exerciser or the trainer. In addition, one or more elastic bands 24 may be placed around arm spindle 11 and peg(s) 22 attached to frame 1, and one or more elastic bands 24 can attach belt 30 and peg(s) 22, as depicted in FIGS. 2 and 3. Finally, belt weight 36 such as chain or other appropriate weight may be attached to belt 30, as shown in FIG. 3. Weights 15, elastic bands 24, and chain 36 exert force against the exerciser's upward motion while performing dips and chins, thus increasing the strenuousness of these exercises as desired by the exerciser and/or the trainer.

Figure 4:
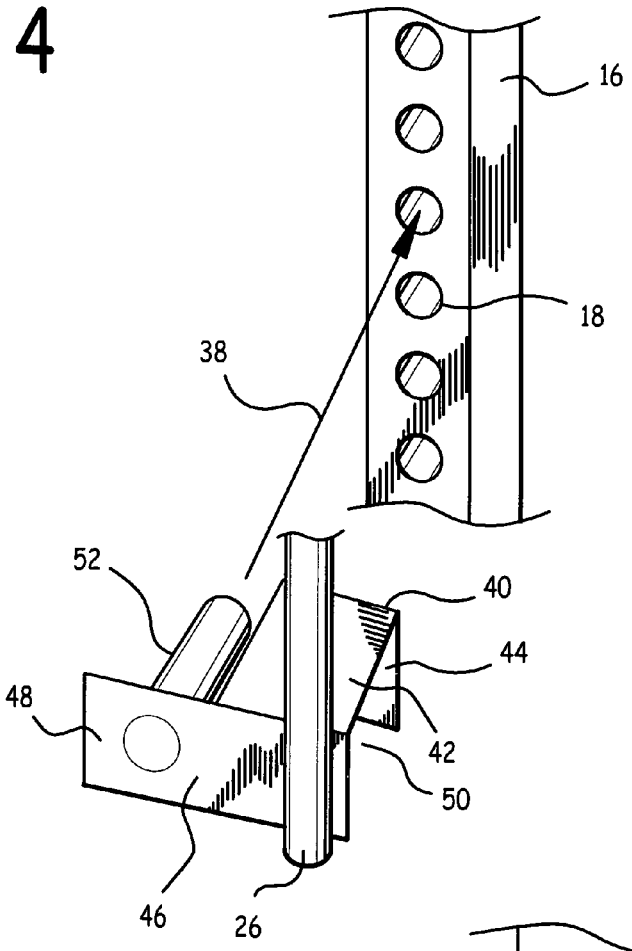
FIGS. 4-6 depict a dip bar bracket being installed on a column.
Figure 5:
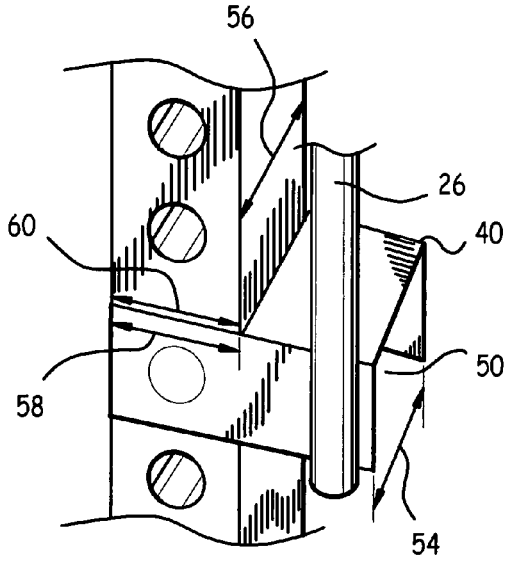
Figure 6:
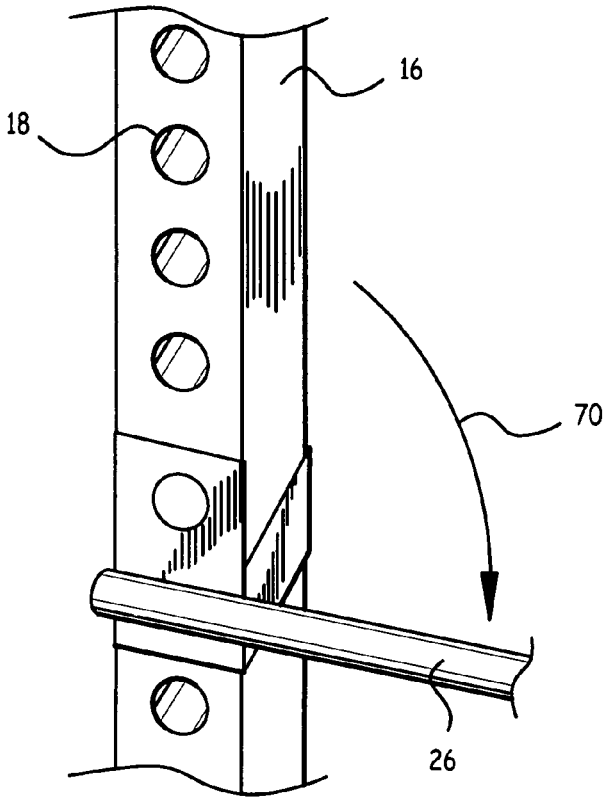

An important feature of the instant invention is the vertical adjustability of dip bars 26 along columns 16. FIGS. 4-6 depict a dip bar 26 bracket 40 being installed on a column 16. Bracket 40 comprises bracket first leg 44 attached along one edge of bracket spine 42, and bracket second leg 46 attached along an opposite edge of bracket spine 42. Bracket first leg 44, bracket spine 42, and bracket second leg 46 define bracket aperture 50, sized to admit column 16.

Bracket second leg 46 comprises bracket second leg extension 48, to which bracket pin 52 is rigidly attached. Each column 16 comprises a plurality of column apertures 18 sized to slidably admit bracket pin 52.

Figure 7:
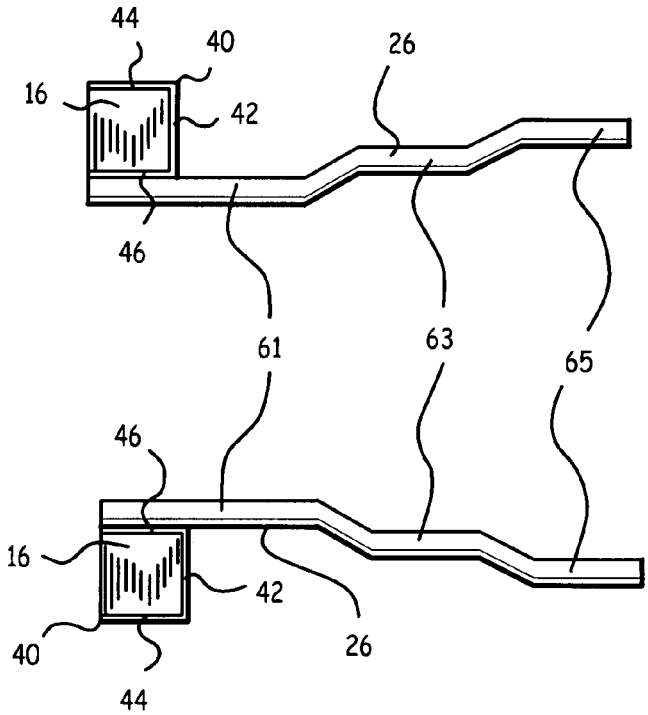
FIG. 7 is a top view of pair of dip bars mounted to respective columns 16, showing a provision of the instant invention to accommodate different sized exercisers by varying the distance between the two dip bars.

Bracket 40 is installed on column 16 by first inserting bracket pin 52 into a column aperture 18 at the desired height on column 16, as indicated by arrow 38 in FIG. 4. After bracket pin 52 is inserted in a column aperture 18 as depicted in FIG. 5, bracket 40 is rotated down around bracket pin 52 as indicated by arrow 70 in FIG. 6 until column 16 is disposed within bracket aperture 50, as depicted in FIGS. 6 and 7.

Bracket 40 may be re-positioned on column 16 by merely reversing the above steps, and then re-installing bracket 40 on column 16 using a different column aperture 18, as desired.

As illustrated in FIG. 5, in the preferred embodiment bracket aperture width 54 was substantially equal to or greater than column width 56, thus permitting column 16 to fit into bracket aperture 50. In addition, in the preferred embodiment bracket second leg extension depth 58 was substantially equal to column depth 60, thus permitting bracket pin 52 to fit into column aperture 18.

Figure 9:
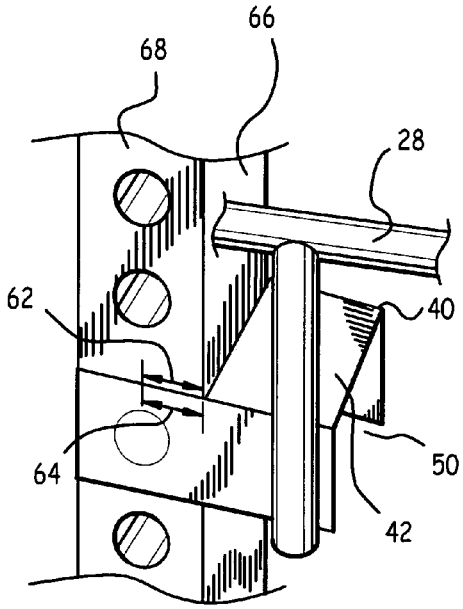

Another way of describing the dimensional relationship between bracket pin 52 on bracket 40 relative to column apertures 18 on column 16 is depicted in FIG. 9, which illustrates that bracket pin offset 64 (from bracket spine 42) is equal to or greater than column aperture offset 62 (from column face 66), thus affording bracket pin 52 the offset clearance required for it to slide into a column aperture 18.

FIG. 7 is a top view of a pair of dip bars 26, each mounted to a respective column 16, showing a provision of the instant invention to accommodate different sized exercisers by varying the distance from the other dip bar 26. In the embodiment depicted in FIG. 7, each dip bar 26 comprised a dip bar first leg 61, a dip bar second leg 63 spaced farther away from the other dip bar 26 than dip bar first leg 61, and a dip bar third leg 65, spaced farther away from the other dip bar 26 than dip bar second leg 63. As may be observed in FIG. 7, the farther the exerciser moves from columns 16, the farther apart dip bars 26 are spaced. The exerciser has merely to choose the dip bar 26 separation best suited for the dips being performed.

Figure 8:
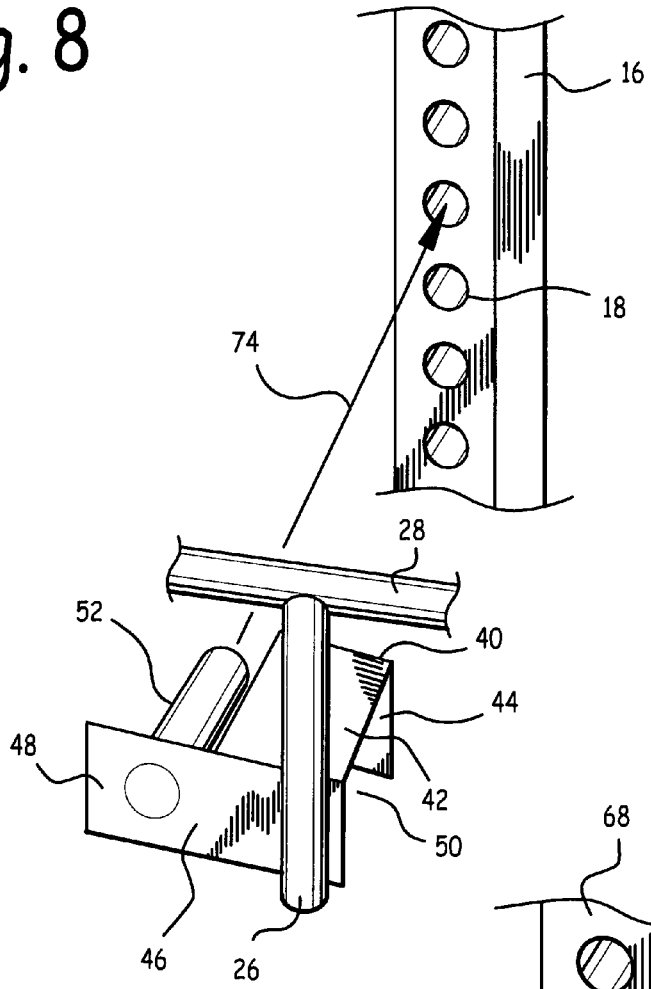
FIGS. 8-10 depict a chin bar bracket being installed on a column.
Figure 10:
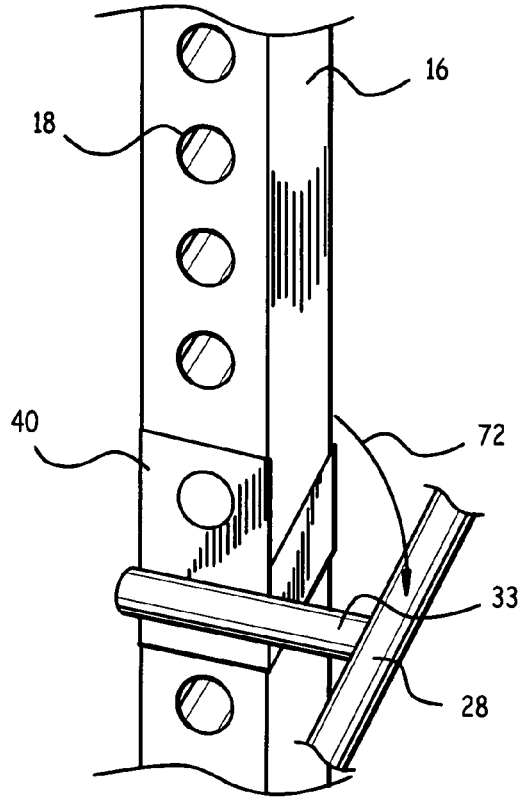

FIGS. 8-10 depict a chin bar 28 bracket 40 being installed on a column 16. The apparatus and method of installation are the same as for bracket 40 with dip bar 26 attached as described above. Bracket 40 is installed on column 16 by first inserting bracket pin 52 into a column aperture 18 at the desired height on column 16, as indicated by arrow 74 in FIG. 8. After bracket pin 52 is inserted in a column aperture 18 as depicted in FIG. 9, bracket 40 is rotated down around bracket pin 52 as indicated by arrow 72 in FIG. 10 until column 16 is disposed within bracket aperture 50, as depicted in FIGS. 10 and 11.

Bracket 40 may be re-positioned on column 16 by merely reversing the above steps, and then re-installing bracket 40 on column 16 using a different column aperture 18, as desired.

Figure 11:
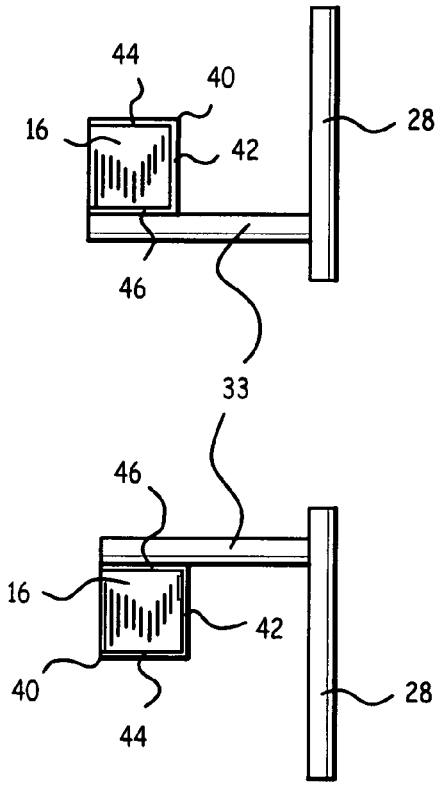
FIG. 11 is a top view of a pair of chin bars 28 mounted to respective columns 16.

FIG. 11 is a top view of a pair of chin bars 28 mounted to respective columns 16 using brackets 40. Chin bar 28 is attached to, and offset from, bracket 40 by means of chin bar support 33. Chin bar support 33 serves to offset chin bar 28 away from column 16 in the direction of the exerciser, thus rendering use of the instant adjustable dip-chin machine more ergonomic and user-friendly.

Referring now also to FIG. 1, each chin bar comprises down-sloping chin bar dogleg 29 attached to chin bar 28 at chin bar dogleg angle 31. The down slope of chin bar dogleg 29 renders chin bar 28 easier to use because it serves to effectively vary the distance between the exerciser and chin bar 28: the farther from columns 16, the lower chin bar dogleg 29 slopes. It was determined experimentally that a chin bar dogleg angle 31 substantially between 5 degrees and 25 degrees was optimal.

Figure 12:
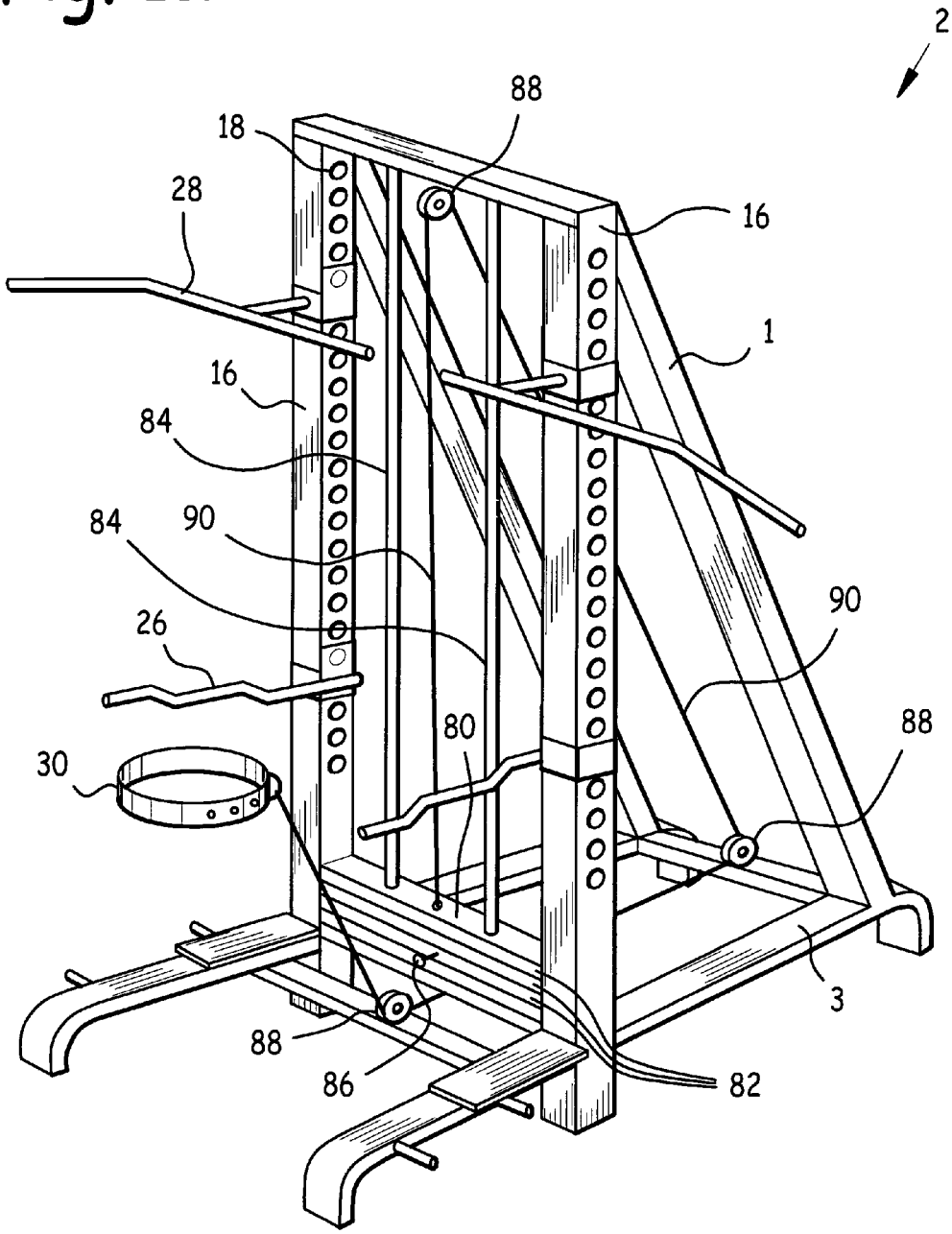
FIG. 12 is a right quarter side isometric view of an alternate embodiment adjustable weight-loaded dip-chin machine incorporating a weight stack.

FIG. 12 is a right quarter side isometric view of an alternate embodiment adjustable dip-chin machine 2 incorporating weight stack 80. Weight stack 80 comprises a plurality of stack weights 82 sliding on weight guides 84. The placement of stack pin 86 determines the amount of stack weights 82 which will be connected to cable 90. Cable 90 is attached to weight stack 80, then is routed through pulleys 88 attached to frame 1 and base 3, and finally attaches to belt 30.

When an exerciser wearing belt 30 moves upwards while performing a dip or chin, belt 30 pulls cable 90, which in turn raises a number of stack weights 82 determined by the placement of stack pin 86. In this embodiment of adjustable dip-chin machine 2, the exerciser and/or trainer determine an appropriate amount of weight to be added for the exercise, stack pin 86 is set accordingly, and then the exerciser performs the dips and/or chins, these exercises being rendered appropriately more strenuous by the addition of weight from weight stack 80.

In addition, as in the preferred embodiment of adjustable dip-chin machine 2 previously described, one or more elastic bands can attach belt 30 to base 3, and chain 36 or other appropriate weight may be attached to belt 30. Weight stack 80, elastic bands 24, and chain 36 exert force against the exerciser's upward motion while performing dips and chins, thus increasing the strenuousness of these exercises as desired by the exerciser and/or the trainer.

Weight stacks 80 are old and well-known in the industry. Thus, although the particular weight stack 80 depicted in FIG. 12 shows stack weights 82 selected by stack pin 86 sliding on weight guides 84, it is intended to fall within the scope of this invention that any weight stack configuration known in the art may be used to supply downward force to belt 30, as described above.

In the preferred embodiment, frame 1, base 3, arm 10, brackets 40, dip bars 26 and chin bars 28 were made of metal, synthetic, or any other appropriate material. Belt 30 was a conventional exercise weight belt. Belt line 32 and cable 90 were any appropriate elongate member, including cable, rope, synthetic, chain, etc. Chain 36 was conventional metal link chain or other appropriate chain. Weight stack 80 was a commercially available weight stack.

While a preferred embodiment of the invention has been illustrated herein, it is to be understood that changes and variations may be made by those skilled in the art without departing from the spirit of the appending claims.

DRAWING ITEM INDEX

1 frame
2 adjustable dip-chin machine
3 base
4 leg
5 foot support
6 foot
8 arm support
9 arm pivot point
10 arm
11 arm spindle
12 arm brace
14 arm ring
15 weight
16 column
18 column aperture
20 column brace
22 peg
24 elastic band
26 dip bar
28 chin bar
29 chin bar dogleg
130 belt
31 chin bar dogleg angle
32 belt line
33 chin bar support
34 arrow
36 belt weight
38 arrow
40 bracket
42 bracket spine
44 bracket first leg
46 bracket second leg
48 bracket second leg extension
50 bracket aperture
52 bracket pin
54 bracket aperture width
56 column width
58 bracket second leg extension depth
60 column depth
61 dip bar first leg
62 column aperture offset
63 dip bar second leg
64 bracket pin offset
65 dip bar third leg
66 column face
68 column spine
70 arrow
72 arrow
74 arrow

80 weight stack
82 stack weight
84 weight guide
86 stack pin
88 pulley
90 cable

I claim:

1. An adjustable dip-chin machine comprising an arm pivotally attached to a base; an arm spindle attached to said arm, said arm spindle being sized to accept weights; a pair of columns; a dip bar removably and directly attached to each said column; and means of adjusting a height of each said dip bar on its respective column; the means of adjusting dip bar height comprising a bracket attached to said dip bar, and a plurality of column apertures in each said column, said bracket comprising a bracket first leg attached along one edge of a bracket spine, and a bracket second leg attached along an opposite edge of said bracket spine, said bracket first leg, bracket second leg, and bracket spine defining a bracket aperture, said bracket aperture being sized to admit one said column, and a bracket pin attached to said bracket second leg, each said column aperture being sized to admit said bracket pin, whereby said bracket pin may be inserted into one said column aperture, and then said bracket rotated about said bracket pin until said column is disposed within said bracket aperture.

2. The adjustable dip-chin machine of claim 1 wherein said column comprises a pair of opposed column faces and a pair of opposed column sides, said plurality of column apertures being disposed in one said column side, and said bracket further comprises a bracket second leg extension and said bracket pin is mounted to said bracket second leg extension, a bracket pin offset from said bracket spine equaling or exceeding a column aperture offset from an adjacent said column face.

3. An adjustable dip-chin machine comprising an arm pivotally attached to a base; an arm spindle attached to said arm, said arm spindle being sized to accept weights; a pair of columns; a dip bar removably and directly attached to each said column; means of adjusting a height of each said dip bar on its respective column; a chin bar removably and directly attached to each said column; and means of adjusting a height of each said chin bar on its respective column; the means of adjusting chin bar height comprising a bracket attached to said chin bar, and a plurality of column apertures in each said column, said bracket comprising a bracket first leg attached along one edge of a bracket spine, and a bracket second leg attached along an opposite edge of said bracket spine, said bracket first leg, bracket second leg, and bracket spine defining a bracket aperture, said bracket aperture being sized to admit one said column, and a bracket pin attached to said bracket second leg, each said column aperture being sized to admit said bracket pin, whereby said bracket pin may be inserted into one said column aperture, and then said bracket rotated about said bracket pin until said column is disposed within said bracket aperture.

4. The adjustable dip-chin machine of claim 3 wherein said column comprises a pair of opposed column faces and a pair of opposed column sides, said plurality of column apertures being disposed in one said column side, and said bracket further comprises a bracket second leg extension and said bracket pin is mounted to said bracket second leg extension, a bracket pin offset from said bracket spine equaling or exceeding a column aperture offset from an adjacent said column face.

5. An adjustable dip-chin machine comprising a pair of columns attached to a base; a dip bar removably and directly attached to each said column; means of adjusting a height of each said dip bar on its respective column; a weight stack attached to a belt, whereby upwards motion of said belt is resisted by stack weights selected from said weight stack; the means of adjusting dip bar height comprising a bracket attached to said dip bar, and a plurality of column apertures in each said column, said bracket comprising a bracket first leg attached along one edge of a bracket spine, and a bracket second leg attached along an opposite edge of said bracket spine, said bracket first leg, bracket second leg, and bracket spine defining a bracket aperture, said bracket aperture being sized to admit one said column, and a bracket pin attached to said bracket second leg, each said column aperture being sized to admit said bracket pin, whereby said bracket pin may be inserted into one said column aperture, and then said bracket rotated about said bracket pin until said column is disposed within said bracket aperture.

6. The adjustable dip-chin machine of claim 5 wherein said each column comprises a pair of opposed column faces and a pair of opposed column sides, said plurality of column apertures being disposed in one said column side, and said bracket further comprises a bracket second leg extension and said bracket pin is mounted to said bracket second leg extension, a bracket pin offset from said bracket spine equaling or exceeding a column aperture offset from an adjacent said column face.

7. The adjustable dip-chin machine of claim 6 wherein each said dip bar comprises a plurality of dip bar legs, said dip bar legs being separated by mutually differing distances from the other said dip bar.

8. The adjustable dip-chin machine of claim 6 further comprising a chin bar removably attached to each said column, and means of adjusting a height of each said chin bar on its respective column.

9. The adjustable dip-chin machine of claim 8 wherein the means of adjusting chin bar height comprises a bracket attached to said chin bar, and a plurality of column apertures in each said column, said bracket comprising a bracket first leg attached along one edge of a bracket spine, and a bracket second leg attached along an opposite edge of said bracket spine, said bracket first leg, bracket second leg, and bracket spine defining a bracket aperture, said bracket aperture being sized to admit one said column, and a bracket pin attached to said bracket second leg, each said column aperture being sized to admit said bracket pin, whereby said bracket pin may be inserted into one said column aperture, and then said bracket rotated about said bracket pin until said column is disposed within said bracket aperture.

10. The adjustable dip-chin machine of claim 9 wherein each said column comprises a pair of opposed column faces and a pair of opposed column sides, said plurality of column apertures being disposed in one said column side, and said bracket further comprises a bracket second leg extension and said bracket pin is mounted to said bracket second leg extension, a bracket pin offset from said bracket spine equaling or exceeding a column aperture offset from an adjacent said column face.

11. An adjustable dip-chin machine comprising a pair of columns attached to a base; a chin bar removably and directly attached to each said column; means of adjusting a height of each said chin bar on its respective column; and a weight stack attached to a belt, whereby upwards motion of said belt is resisted by stack weights selected from said weight stack; the means of adjusting chin bar height comprising a bracket attached to said chin bar, and a plurality of column apertures in each said column, said bracket comprising a bracket first leg attached along one edge of a bracket spine, and a bracket second leg attached along an opposite edge of said bracket spine, said bracket first leg, bracket second leg, and bracket spine defining a bracket aperture, said bracket aperture being sized to admit one said column, and a bracket pin attached to said bracket second leg, each said column aperture being sized to admit said bracket pin, whereby said bracket pin may be inserted into one said column aperture, and then said bracket rotated about said bracket pin until said column is disposed within said bracket aperture.

12. The adjustable dip-chin machine of claim 11 wherein each said column comprises a pair of opposed column faces and a pair of opposed column sides, said plurality of column apertures being disposed in one said column side, and said bracket further comprises a bracket second leg extension and said bracket pin is mounted to said bracket second leg extension, a bracket pin offset from said bracket spine equaling or exceeding a column aperture offset from an adjacent said column face.

* * * * *